US006786015B2

(12) United States Patent
Wilt

(10) Patent No.: US 6,786,015 B2
(45) Date of Patent: Sep. 7, 2004

(54) LOG WALL SIDING SYSTEM

(76) Inventor: Joseph L. Wilt, 559 Foot of Ten Rd., Duncansville, PA (US) 16635

( * ) Notice: Subject to any disclaimer, the term of this patent is extended or adjusted under 35 U.S.C. 154(b) by 13 days.

(21) Appl. No.: 10/266,461

(22) Filed: Oct. 8, 2002

(65) Prior Publication Data

US 2003/0024187 A1 Feb. 6, 2003

Related U.S. Application Data

(63) Continuation-in-part of application No. 09/850,562, filed on May 7, 2001, now abandoned.

(51) Int. Cl.[7] ..... E04B 1/10; E04D 1/00; E04C 3/30

(52) U.S. Cl. ..... 52/233; 52/519; 52/578; 52/536

(58) Field of Search ..... 52/233, 529, 519, 52/536, 539, 546, 578

(56) References Cited

U.S. PATENT DOCUMENTS

| | | | | | |
|---|---|---|---|---|---|
| 2,309,426 | A | * | 1/1943 | Williams | 52/233 |
| 3,262,239 | A | * | 7/1966 | Mills | 52/540 |
| 4,947,600 | A | * | 8/1990 | Porter | 52/235 |
| 5,181,358 | A | * | 1/1993 | Mead | 52/233 |
| 5,347,784 | A | * | 9/1994 | Crick et al. | 52/520 |
| 5,537,792 | A | * | 7/1996 | Moliere | 52/531 |
| 5,581,968 | A | * | 12/1996 | Laurie et al. | 52/538 |
| 5,586,422 | A | * | 12/1996 | Hoffner | 52/529 |
| 5,638,649 | A | * | 6/1997 | Hovland | 52/233 |
| 5,836,123 | A | * | 11/1998 | Gulino | 52/288.1 |
| 5,878,542 | A | * | 3/1999 | Cornelius | 52/519 |
| 6,199,332 | B1 | * | 3/2001 | Ellson | 52/233 |
| 2003/0024187 | A1 | * | 2/2003 | Wilt | 52/233 |

* cited by examiner

*Primary Examiner*—Carl D. Friedman
*Assistant Examiner*—Kevin McDermott
(74) *Attorney, Agent, or Firm*—McKay & Associates, P.C.

(57) ABSTRACT

A wall siding system for simulating a log wall structure having notched, interlocking log ends includes a plurality of cambered side planks with each side plank having opposed longitudinal tongue and groove edges for interconnecting to adjacent side planks so that the side planks can be secured to vertical wall surfaces, and a plurality of end caps that straddle and cover the corner of adjoining vertical wall surfaces and that are securable to each adjacent vertical wall surface for creating an alternating and interlocking arrangement thereby simulating authentic notched log ends. The end caps project past the corner of adjoining vertical wall surfaces whereupon the end caps that are secured to spacer elements of one vertical wall surface alternate with and project at a right angle to the end caps secured to the spacer elements of the adjoining vertical wall surface.

14 Claims, 8 Drawing Sheets

FIG. 5
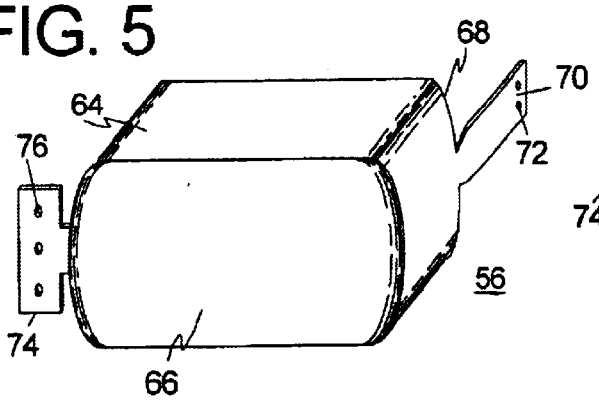
FIG. 5a
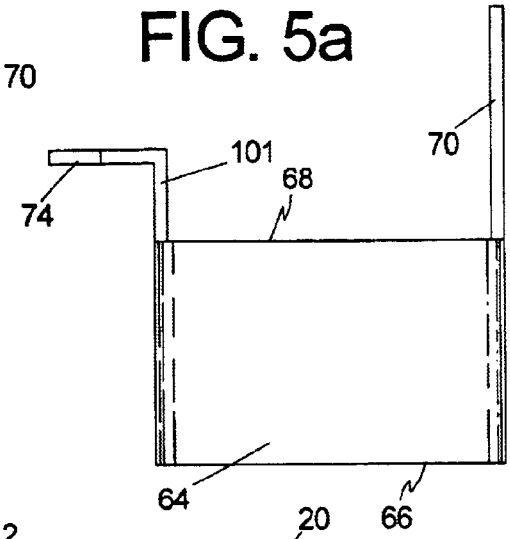
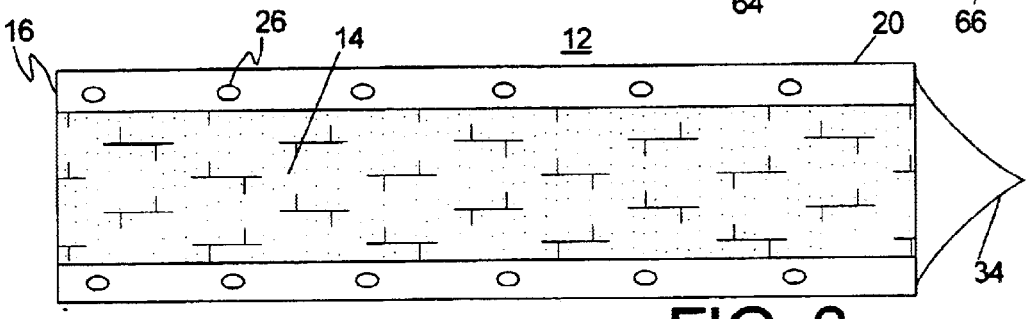
FIG. 6
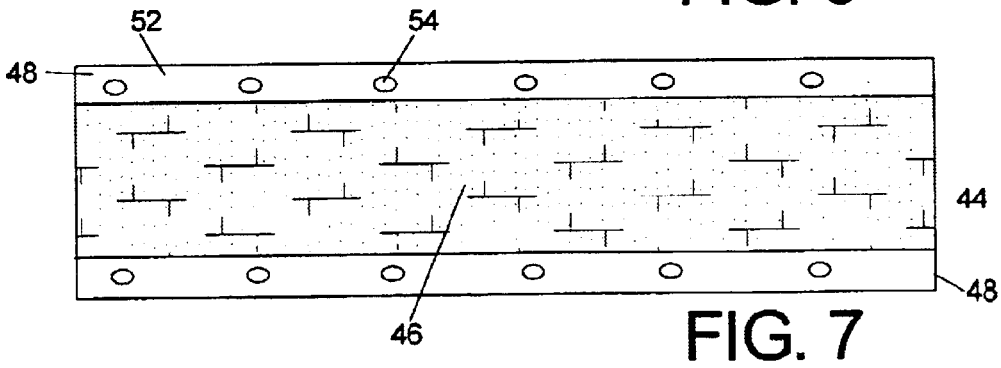
FIG. 7
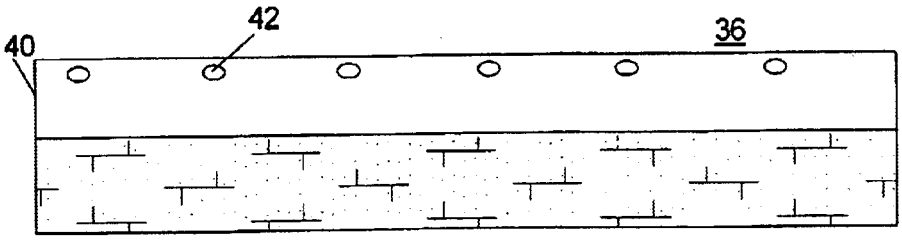
FIG. 8

LOG WALL SIDING SYSTEM

SPECIFIC REFERENCE

The present application is a continuation-in-part of application Ser. No. 09/850,562, filed May 7, 2001 now abandoned.

BACKGROUND OF THE INVENTION

The present invention pertains to siding components for building structures, and, more particularly, pertains to a wall siding system for simulating a log wall structure that has notched, interlocking log ends projecting from the corners of the building structure.

Log cabin dwellings have a special place in the American psyche, as they are tangible reminders of a noteworthy pioneer and frontier heritage.

Although only a few tools (long-handled axes, mallets, and wedges) were required in their construction, log cabin dwellings were labor intensive, sturdy structures. The builders of log cabin dwellings typically used three types of logs: round, hewn on both sides, and squared. The logs for each face of the dwelling had to be of relatively the same dimension so that the cracks between the respective logs could be easily chinked (filled) with moss, clay or mud. The ends of the logs were shaped to form either a taper or blunt face. Two opposed, v-shaped notches were cut slightly inward of the ends of each log that formed the wall structure. The v-shaped notches were cut to provide for the interlocking arrangement of the log ends and for tightly fitting together at their corners all of the logs that formed the walls of the log cabin dwelling.

In addition, four thick logs made up the foundation upon which the log cabin walls were then built up in an alternating manner with the interlocking arrangement at the corners of the walls. The logs were generally between 12 and 15 feet long, and as the log cabin walls were built up, openings for doors, windows, and fireplaces were provided and subsequently formed and framed. A second method of constructing the log cabin walls was to forego the shaping of the v-shaped notches at the log ends and simply stack the round logs up from the foundation in an alternating arrangement. This method would create even larger gaps between the stacked logs, and thus required an even greater amount of chinking to fill the gaps between the logs.

While log cabin dwellings were the principal form of dwelling well into the post-Civil war era, today they occupy a small and specialized niche in the residential home construction market. Due to a number of factors including high overall construction costs, the relative difficulty of obtaining high quality choice hardwood, and the requisite specialized carpentry skills necessary for proper log dwelling construction, log cabin homes are generally an option for only those individuals in the upper income brackets.

Therefore, various systems, components, and structural members have been devised to imitate or simulate a log cabin dwelling.

Among the prior art patents which disclose imitation log siding members that engage or interlock along their longitudinal edges are the Mead (U.S. Pat. No. 5,181,358) and the Cornelius (U.S. Pat. No. 5,878,542) patents. For example, Mead discloses simulated convex-shaped log members having one longitudinal edge shaped as an inwardly turned flange and the other longitudinal edge formed into a v-shaped trough thus allowing the inwardly turned flanges of one log member to engage the v-shaped trough of an adjacent log member so that the log members can be secured to each other and then mounted to a vertical wall surface.

Cornelius discloses simulated log members that are arcuate-shaped and include one longitudinal lower edge and an opposite longitudinal receiving slot whereupon the lower edge of one log member fits into the receiving slot of an adjacent log member so that the log members can be coupled together and then mounted to the wall of a structure.

Hoess (U.S. Pat. No. 2,250,764) discloses simulated log members in the form of convex metallic members that interlock to each other by longitudinal flanges for nailing the convex metallic members to wall studding.

Goldade (U.S. Pat. No. 4,312,161) discloses interfitting cylindrical log members wherein each log member has opposed grooves that allow the log members to be interfitted together in order to form the walls of a building structure.

The Grubbs (U.S. Pat. No. 4,012,876), Mizia et al. (U.S. Pat. No. 5,271,878), Woolems et at. (U.S. Pat. No. 5,423,153), and Civelli (U.S. Pat. No. 5,577,357) disclose half log systems or components for simulating log cabin siding.

Grubbs uses convex-shaped, half log cores to simulate a log building. Elongated filler strips are disposed between each half-log core to provide a weather seal and create a continuous log building appearance.

Mizia et al. discloses a simulated half-log having a generally semi-cylindrical foam core, and which is attachable to a vertical wall surface by nailing the half logs to splines which are themselves nailed to the vertical wall surfaces.

Woolems et al. discloses outwardly bowed simulated log planks with each log plank having a rabbet along one long edge and a notch at the opposite long edge so that the planks can be interfitted to each other and then nailed to the building surface.

Civelli discloses half log siding members that are held in place on the wall surface by elongated mounting strips which are fastened to the wall surface.

The Felser (U.S. Pat. No. 4,592,182) and Berge (U.S. Pat. No. 4,878,328) patents each disclose components and systems that simulate log wall siding and log wall end or corner configurations.

Specifically, Felser attaches log blocks to the ends of planks that crisscross as the planks extend past the corner studs of building structures thereby imitating notched log ends.

Berge attaches right and left corner assemblies to the projecting ends of modular planks, and the surfaces at the ends of the modular planks and the corner assemblies are shaped to conform to each other for a tight securement of the corner assemblies to the ends of the modular planks.

Nonetheless, despite the variety of simulated log wall siding components and systems, there remains a need for an imitation or simulated log wall siding system that is easy to install, is adaptable for both indoor and outdoor wall surfaces, and includes end or corner members that provide a notched corner wall appearance.

SUMMARY OF THE INVENTION

The present invention comprehends a wall siding system for simulating the appearance of a log wall structure having notched, interlocking ends.

The wall siding system of the present invention includes a plurality of elongated side planks with each side plank having an arched or cambered central portion and opposed longitudinal edges with each longitudinal edge further defined by a flat tongue and a groove both of which are coequal in length with the cambered central portion. Further, each tongue has apertures spaced along the length of the tongue for allowing fasteners to be inserted therethrough so that the side planks can be secured in a side-by-side vertical arrangement on the vertical wall surface. The side planks that are secured adjacent to the corners of each vertical wall surface may include one projecting member that extends outwardly from the cambered portion to facilitate the securement of the end side planks at the corners of adjoining vertical wall surfaces.

In order to simulate the interlocking and notched ends of authentic log planks, the present invention includes cylindrical-shaped end caps that are securable to and straddle the angled (preferably right-angled) corners of interior or exterior walls of any building structure. Each end cap includes a t-shaped tab projecting laterally from the main body portion of the end cap attached to the wall-facing end of the end cap. In a preferred embodiment, this t-shaped tab is offset from the wall-facing end by an extension member that is perpendicular to the wall-facing end. A regular or straight tab projects opposite from and perpendicular to the t-shaped tab; and both the t-shaped tab and the regular tab have apertures for allowing fasteners to be inserted therethrough so that each end cap can be secured to adjoining wall surfaces for straddling the corner of those respective wall surfaces. Thus, as each end cap is secured in turn at the corner of the adjoining wall surfaces, the t-shaped tab of each end cap will be secured to one wall surface while the regular tab will be secured to a spacer element of the adjoining wall surface thereby creating the notched, interlocking and projecting plank ends that simulate the notched and interlocking ends of authentic log planks.

In the preferred embodiment, the wall siding system includes at least two spacer elements, each spacer element is attached to one of adjacent vertical wall surfaces near a corner; a plurality of end caps, each end cap including a cylindrical-shaped main body portion, a cambered exterior end, a wall-facing end, a t-shaped tab attached to the wall-facing end and offset therefrom by an extension member perpendicularly attached to the wall-facing end configured to be secured on the wall next to one of the spacer elements, whereby the spacer is situated underlying the wall-facing end, and a regular tab projecting from the wall-facing end opposite from and perpendicular to the t-shaped tab configured to attach to the other of the spacer elements on the other of the vertical wall surfaces.

The wall siding system also includes elongated starter strips that are attached to the lowermost portion, or sill, of the vertical wall surfaces for providing a starting point for the securement of the side planks to the wall surface. In addition, the wall siding system includes flat starter members having opposed tongue and groove longitudinal edges for insuring that the arrangement of the side planks on each respective wall surface, and the alternating arrangement of end caps, completely covers the requisite surface area of the dwelling or building structure.

Because the end caps are preferably hollow, the interior of each end cap could possibly become a nesting place for birds and animals; this would especially be the case for the end caps secured at the lowest point of each corner of adjacent wall surfaces. Therefore, a trough-shaped corner sealer is secured at the lowest point of each corner for receiving the lowest, or starting, end cap. The corner sealer seals off the starting end cap from the external environment.

It is an objective of the present invention to provide a wall siding system that simulates a notched log wall structure using standard construction techniques.

It is another objective of the present invention to provide a wall siding system that can be used on both interior and exterior vertical wall surfaces.

Yet another objective of the present invention is to provide a wall siding system that can be retrofitted for application to interior or exterior wall surfaces of existing dwellings and buildings as well as adapted for use as the interior or exterior wall surfaces of new dwellings and buildings.

Still another objective of the present invention is to provide a wall siding system that simulates a notched log wall structure but is more energy efficient than authentic log wall building structures.

The above and other features and advantages of the present invention will become apparent from the following description when read in conjunction with the accompanying drawings, wherein like reference numerals designate the same elements.

BRIEF DESCRIPTION OF THE DRAWINGS

FIG. 5 is a perspective view of one end cap.

FIG. 5*a* is a top view of one end cap.

FIG. 6 is front elevational view of the cambered side plank first shown in FIG. 1 illustrating one embodiment of a projecting member projecting outwardly from one end of the cambered side plank.

FIG. 7 is a front elevational view of the starter plank member first shown in FIG. 2.

FIG. 8 is a front elevational view of the wall starter strip first shown in FIG. 3.

DETAILED DESCRIPTION OF THE PREFERRED EMBODIMENT

Figure 1:
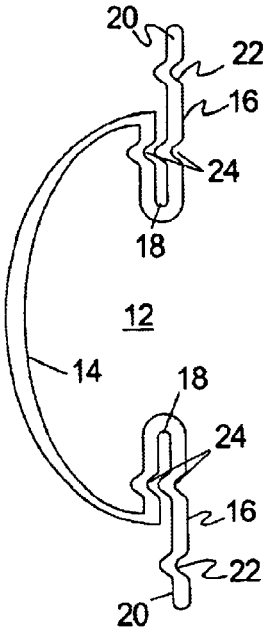
FIG. 1 is a side elevational view of one cambered side plank.

Illustrated in FIGS. 1–15 is a log wall siding system 10 for simulating authentic log walls, and specifically imitating the notched, interlocking, and projecting corners of a log wall structure. The log wall siding system 10 of the present invention can be used on both exterior and interior vertical wall surfaces. Moreover, the log wall siding system 10 can be retrofitted onto existing interior and exterior vertical wall surfaces as well as being attachable to sheathing and studs to form an original wall surface that simulates a log wall in appearance. Thus, the log wall siding system 10 of the present invention can be used by do-it-yourself home remodelers to turn an ordinary wall, such as the walls of a gameroom, into an attractive, simulated log wall paneling, or the log wall siding system 10 can form the exterior vinyl siding as part of a new building or home construction.

The log wall siding system 10 includes a number of structural elements, the majority of which are manufactured from durable, flexible vinyl, that allows it to be quickly and easily mounted to interior or exterior vertical wall surfaces. In addition, many of the structural elements are reversible in orientation and have universal attaching and connecting features thereby avoiding the need for specialized pieces for covering and finishing exterior or interior corners and left side and right side surfaces. For an existing dwelling the wall siding system 10 can completely cover the walls of the dwelling extending from the sill and foundation to the eaves.

As illustrated in FIGS. 1–15, the wall siding system 10 includes a plurality of elongated wall or side planks 12 that are attachable to one or more vertical wall surfaces in a side-by-side, horizontal arrangement for completely covering each respective vertical wall surface. Each side plank 12 is disposed in side-by-side arrangement with other side planks 12 in a series of contiguous horizontal rows and extending up each vertical wall surface. The side planks 12 include an arcuate, cambered or convex-shaped central or middle portion 14 and opposed longitudinal edges 16 that are integrally formed from the cambered central portion 14 and coequal in length therewith. Furthermore, each longitudinal edge 16 includes an inwardly extending groove 18 and a flat tongue 20 that extends outwardly past the arc of curvature of the cambered central portion 14. Thus, the tongues 20 for each side plank 12 extend outwardly away from each other but are coplanar while the grooves 18 of each side plank 12 are also coplanar and extend inwardly toward each and are hidden by the curvature of the cambered central portion 14. The outward or lateral extension of each tongue 20 allows the tongue 20 of one side plank 12 to be inserted and received within the groove 18 of a contiguously mounted side plank 12 disposed either above or below that respective side plank 12 on the wall surface. In addition, each opposed tongue 20 includes a semi-circular recess or slot 22 that extends the length of each tongue 20. Further, each opposed groove 18 is defined by a pair of arcuate channels 24 that extend the length of each groove 18 and are parallel with each other and coequal in length with each respective groove 18. The semi-circular recesses 22 and the arcuate channels 24 facilitate the interconnection of the side planks 12 to each other as the side planks 12 are assembled on the various wall surfaces. The tongue 20 of each side plank 12 also includes spaced-apart apertures 26 that are located adjacent the edge of each tongue 20. The generally elongate or oval-shaped apertures 26 permit fasteners 28, such as siding nails, to be passed therethrough for securing the side planks 12 to the wall surfaces. The oval-shaped apertures 26 allow some lateral movement or play in the side planks 12 to accommodate temperature changes that over time may very slightly swell or shrink the side planks 12.

Figure 10:
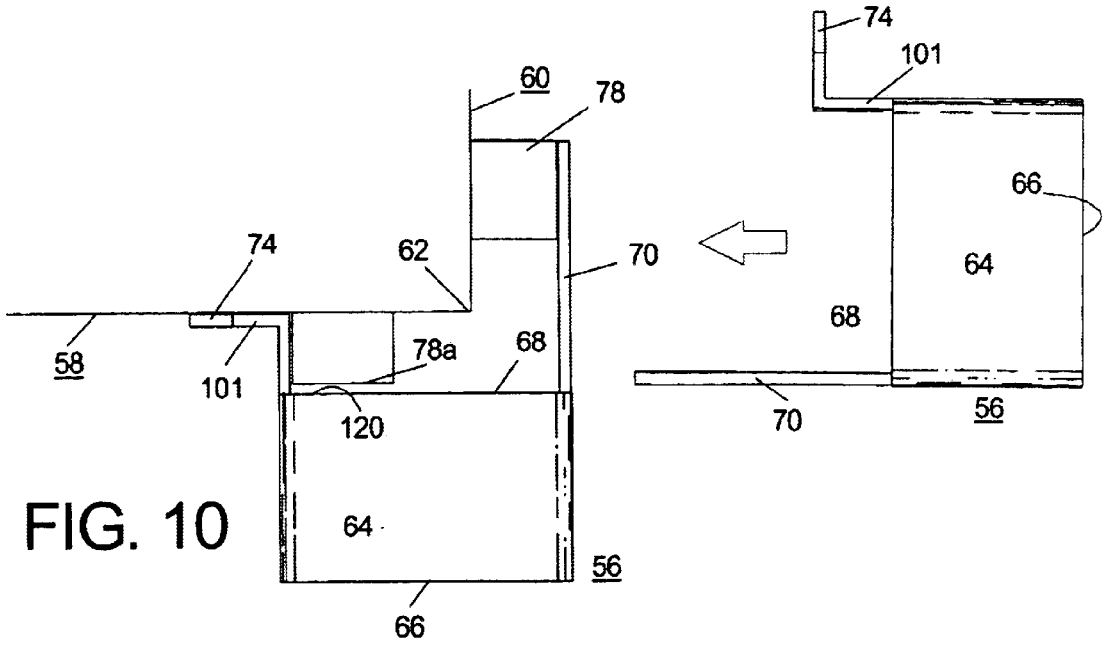
FIG. 10 is a top view at the corner of a house showing the placement of the end caps.
Figure 10A:
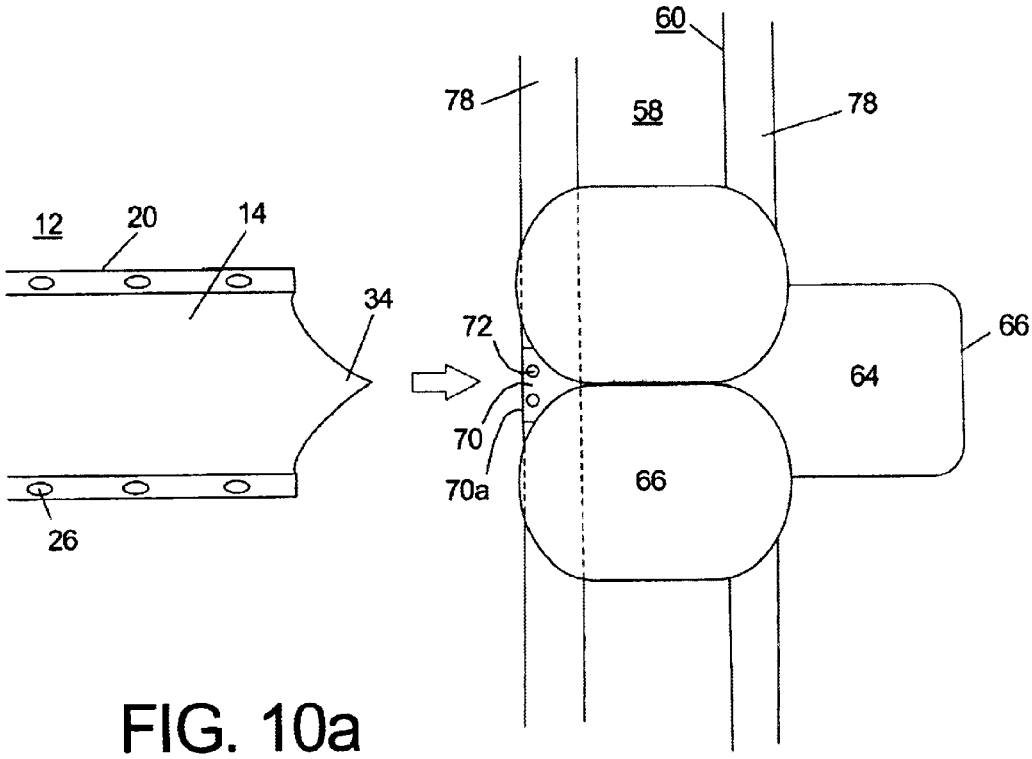
FIG. 10*a* is the side view of the resulting configuration when the end caps are secured at the corner.
Figure 11:
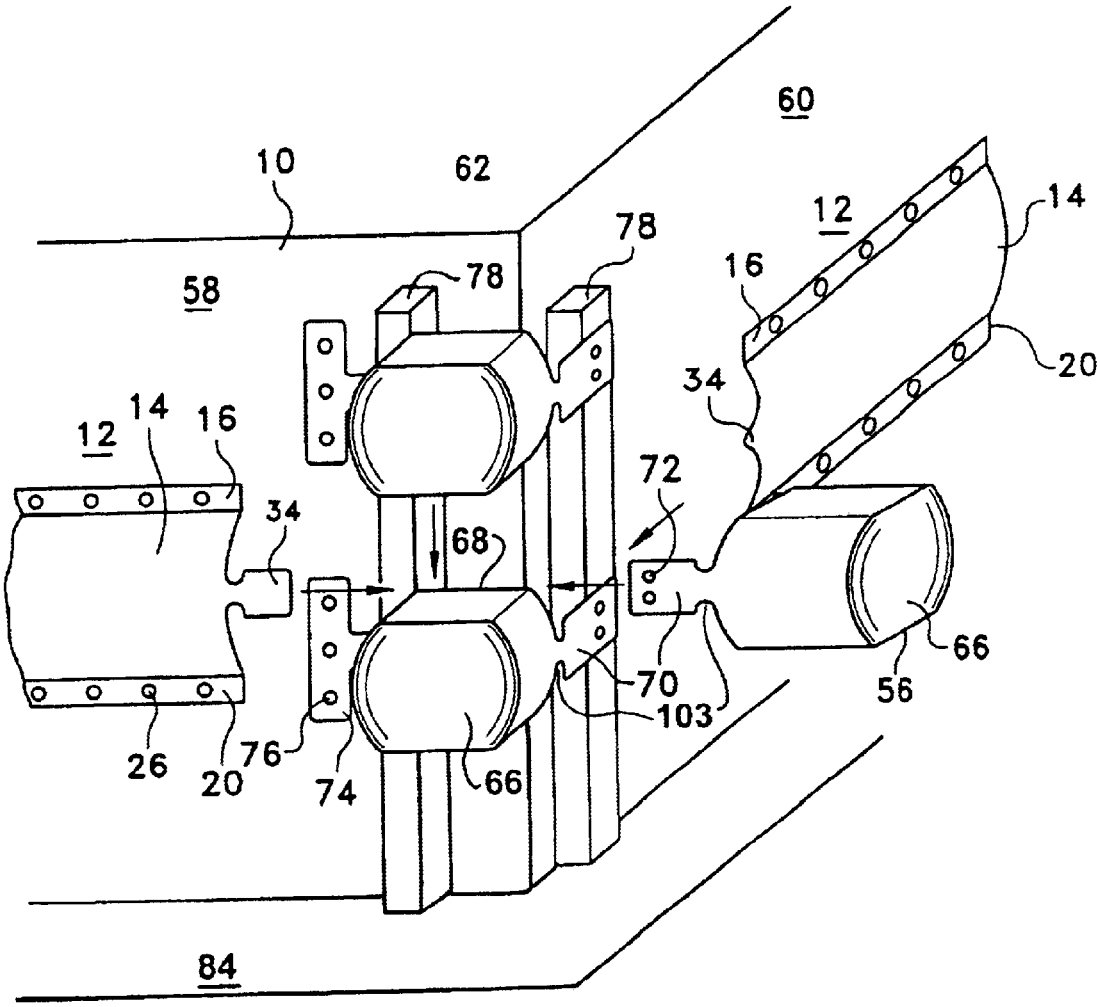
FIG. 11 is a perspective view illustrating the securement of end caps and cambered side planks along the spacer elements at the corner of adjoining vertical wall surfaces.

As illustrated in FIGS. 6, 10*a*, and 11, the side planks 12 that are disposed on wall surfaces 58, 60 adjacent the corner 62 of the dwelling may include a projecting tongue or projecting member 34. The projecting member 34 extends outwardly from the peak of the cambered portion 14 of the side plank 12 and is located equidistant from each longitudinal edge 16. The projection member 34 may be configured in any manner that aesthetically facilitates the fitting and securement of the side plank at and/or slightly underneath an end cap structural member as will be further described. In the present embodiment, these specially configured side planks would only be disposed on each wall surface 58, 60 adjacent the corner 62, and the projection member 34 would be generally shaped (triangular or tab-like) to conform to interfit between the pair of stacked, mounted end cap structural members.

Figure 3:
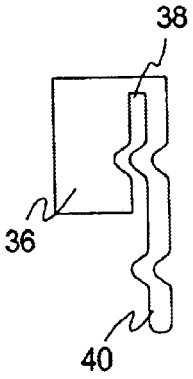
FIG. 3 is a side elevational view of one wall starter strip.
Figure 14:
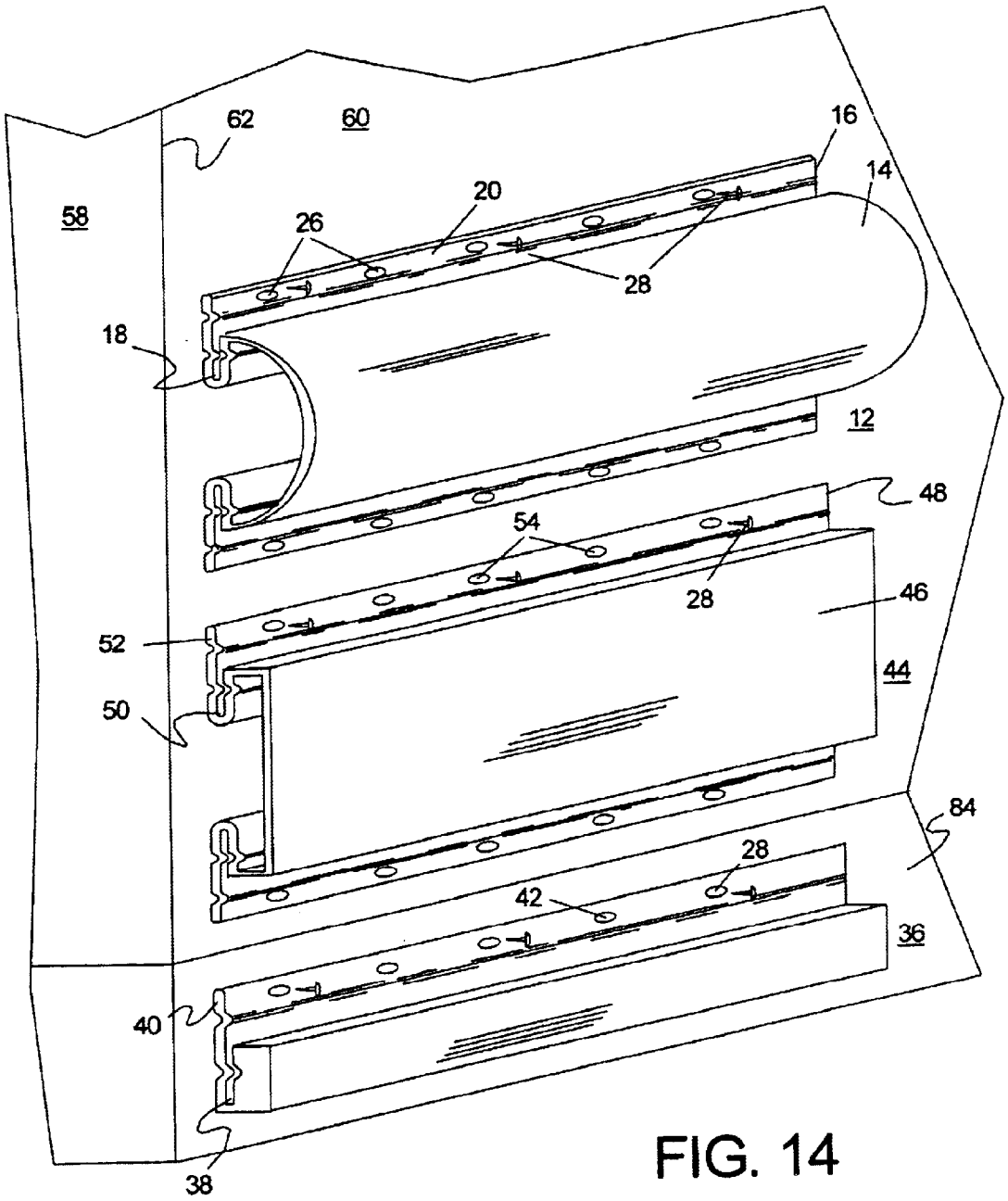
FIG. 14 is a perspective view illustrating the securement of one cambered side plank, one starter plank member, and one wall starter strip to a side wall surface and adjacent the corner thereof.

Illustrated in FIGS. 3, 8 and 14 is a wall starter strip 36 that is securable to the foundation or sill of the dwelling, and for typical dwellings the wall starter strip 36 would be secured to the entire sill—front, back and both sides. The wall starter strip 36 is elongated and rectangular-shaped in cross section, and includes both a groove 38 and a flat, laterally extending tongue 40 that are coequal in length with each other. Each wall starter strip 36 also includes a series of preferably slightly elongated slots 42 spaced along the tongue 40 and through which fasteners 28 can be inserted for securing the wall starter strip 36 to the sill of the dwelling. The wall starter strip 36 can come in various lengths such as six and eight feet (or longer), and depending on the lengthwise dimensions of the sill, one or more wall starter strips 36 will need to be secured in a horizontal arrangement, end-to-end, along the sill of the dwelling.

Figure 2:
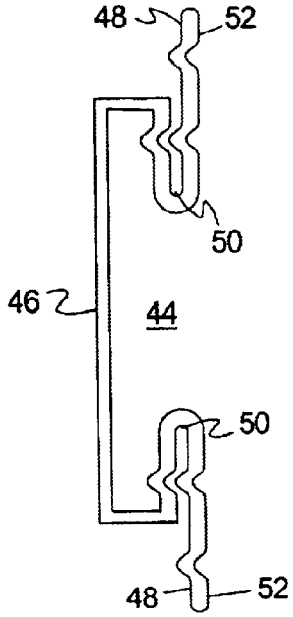
FIG. 2 is a side elevational view of one starter plank member.

Illustrated in FIGS. 2, 7 and 14 is a starter plank member 44 that is generally only secured to the side wall surfaces, and not the front and back wall surfaces of the dwelling. The starter plank members 44 include an elongated flat central portion 46 and oppositely disposed longitudinal edges 48, with each longitudinal edge 48 including an inwardly projecting groove 50, and the grooves 50 being coplanar to each other. Also, each starter plank member 44 includes an outwardly extending tongue 52, and the tongues 52 are also coequal in length and coplanar to each other. Each starter plank member tongue 52 has apertures 54 spaced along its length to allow fasteners 28 to be inserted therethrough for attaching the starter plank members 44 to the lowest portion of the respective side wall surface and immediately above the wall starter strip 36. The starter plank members 44 may come in standard six or eight feet lengths, and thus one or more starter plank members 44 will need to be secured in a horizontal end-to-end arrangement at the lowest portion of the side wall surface of the dwelling.

Shown in FIGS. 5, 5*a*, and 10–11, are the structural members which simulate the notched, interlocking ends of authentic log cabin sidewalls. More specifically, these figures illustrate end caps 56 that are mounted to adjacent wall surfaces 58 and 60, and which extend past the corner 62 (FIG. 10) of the adjoining wall surfaces 58 and 60 in order to simulate the notched, interlocking ends of the wood planks that form the walls of a log cabin dwelling. Each end cap 56 includes a cylindrical-shaped, generally hollow main body portion 64 that defines a longitudinal axis extending through the main body portion 64, and an exterior or outwardly facing end 66 that is either flat or has a curved or rounded shape. Opposite of the exterior-facing end 66 is a wall-facing end 68 that is inwardly disposed in either an adjacent or abutting relationship to the respective vertical wall surfaces 58 and 60.

In order to attach the end caps 56 to the wall surfaces 58 and 60, each end cap 56 includes a regular tab 70 that is integrally attached to the main body portion 64 and projects from the wall facing end 68 parallel with the longitudinal axis of the main body portion 64. The regular tab 70 includes at least one, but preferably a pair of spaced-apart holes 72 through which fasteners 28 are inserted for securing the regular tab 70 to a spacer element 78 mounted on wall surfaces 58 and 60. Each end cap 56 also includes a t-shaped tab 74 that projects laterally from the end cap wall-facing end 68, and which may be offset by an extension member 101 that is perpendicular to the wall-facing end integrally attached and medially located at the peripheral side of the wall-facing end 68 and opposite of the regular tab 70. The t-shaped tab 74 thus projects at a right-angle to the regular tab 70, and includes at least one, but preferably three apertures 76 through which fasteners 28 can be passed for affixing the t-shaped tab 74 to wall surfaces 58 and 60, next to another spacer element 78.

As shown in FIGS. 10–11, each end cap 56 straddles the corner 62 of the adjoining wall surfaces 58 and 60 so that the regular tab 70 can be secured to a spacer element 78 of one wall surface 58 and the t-shaped tab 74 can be secured to the adjoining wall surface 60, next to the other spacer element 78. As shown in this embodiment, the spacer elements 78 are configured as generally rectangular nailing strips that travel the height of the corner 62. The spacer elements 78 are sized to protrude away from the surface of each wall 58, 60 up to but not contacting the wall-facing end of the end cap 56. Thus, the spacer elements 78 are situated within the space allowed by the extension member 101 of the mounted t-shaped tab 74 (between wall surfaces 58, 60 and wall-facing end 68 of end cap 56) and configured with dimensions that produce a gap 120 between a top surface 78*a* of the spacer element 78 and the wall-facing end 68. The regular tab 70 of any adjoining end cap 56 is thus capable of being fixedly mounted between gap 102, under wall-facing end 68 and slightly overlapping any other below-mounted regular tab 70. The overlapping may be facilitated by providing notches 103 at ends proximal to the wall-facing end 68.

As shown in FIG. 10*a*, regular tab 70 is situated under and between stacked end caps 56 having its outermost end 70*a* relative to the wall-facing end 68 (FIG. 10) mounted on spacer element 78 using holes 72. Allowed by the curvature of the end cap 56, which should match the arc of curvature of the cambered central portion 14 (FIG. 1), the revealed outermost end 70*a* may then be covered by projecting member 34 of the side plank 12, the outermost tip of which can either slide slightly underneath the wall facing end 68 and be held by friction along with any fasteners, or simply rest against main body portion 64 of end cap 56. The arc of curvature of the cambered central portion 14 (FIG. 1) and the end caps 56 may obviously vary, but in the present invention it has been shown to be successful when the curvature extends about 2 inches radially. Thus, the space between the wall surfaces 58, 60 and the wall-facing end 68 is similar in width produced by the extension member 101 of the t-shaped tab 74.

Figure 12:
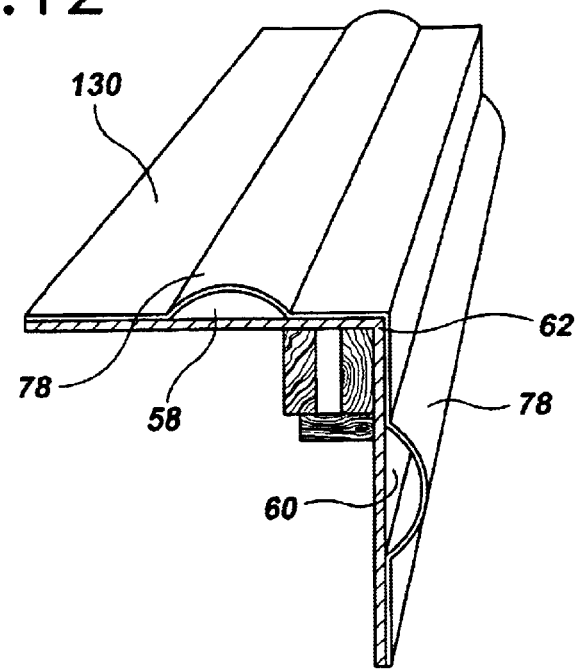
FIG. 12 is a perspective view of an alternative embodiment of a spacer element.
Figure 12A:
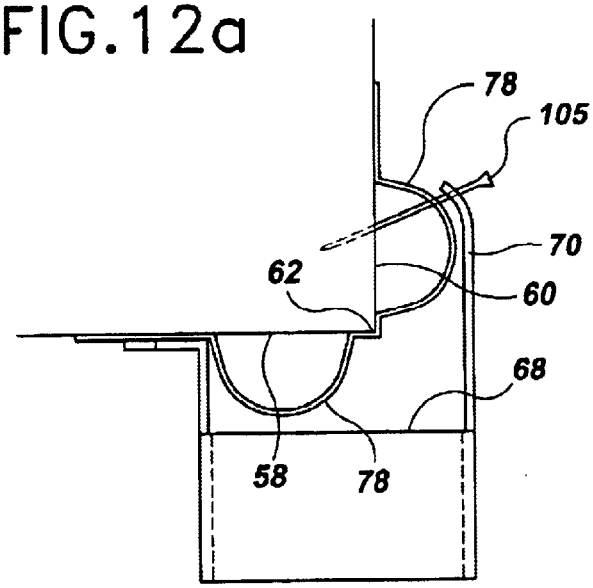
FIG. 12*a* is a top view of the alternative spacer element at the corner of a house.

FIGS. 12 and 12*a* show an alternative embodiment of the spacer element 78 that may provide enhanced water-tight assemblage. Instead of using a rectangular nailing strip type of spacer element 78, the spacer element 78 may be configured as a plastic or vinyl, flexible corner flashing 130 that travels the height of and envelopes the corner 62 and nearby wall surfaces 58, 60, which spacer elements 78 would be configured as raised sections generally semi-circular or trapezoidal in cross-section. Here, a fastening means such as a self-tapping screw 105 would fasten the regular tab 70 to the spacer element 78, thereby decreasing the size of any opening that would lie underneath the wall-facing end 68.

Figure 13:
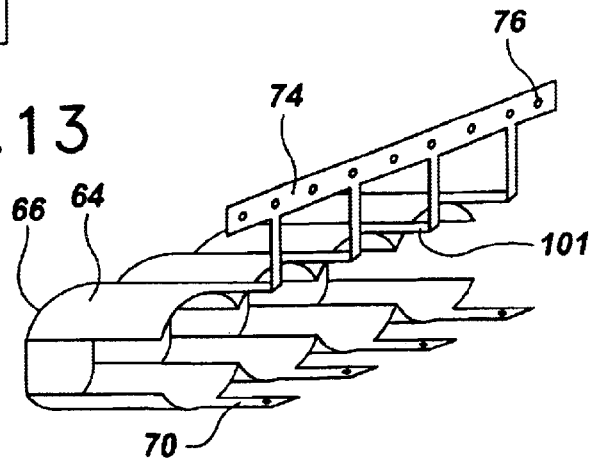
FIG. 13 is a perspective view of an alternative embodiment of the end caps being pre-formed.

Each end cap 56 may also be manufactured as an individual unit or may be grouped together as an integral, "gang" of end caps pre-attached to one another as shown in FIG. 13. In this embodiment, t-shaped tab 74 is one integral piece having the plurality of apertures 76. This may be a preferred embodiment to lessen installation time and since the standard or typical distance from sill plate to eave on a home is nine feet.

The main body portion 64 of each end cap 56 is preferably hollow to provide for ease of storage, transport, and construction. It could also be envisioned that top and bottom surfaces of the main body portion be completely absent to facilitate packaging and transportation, since the surfaces are actually covered by another stacked end cap 56. Sometimes also a structural member may be needed for closing off from the external environment the end caps 56 that are lowermost secured to any (front, back or sides) of the wall surfaces.

Figure 4:
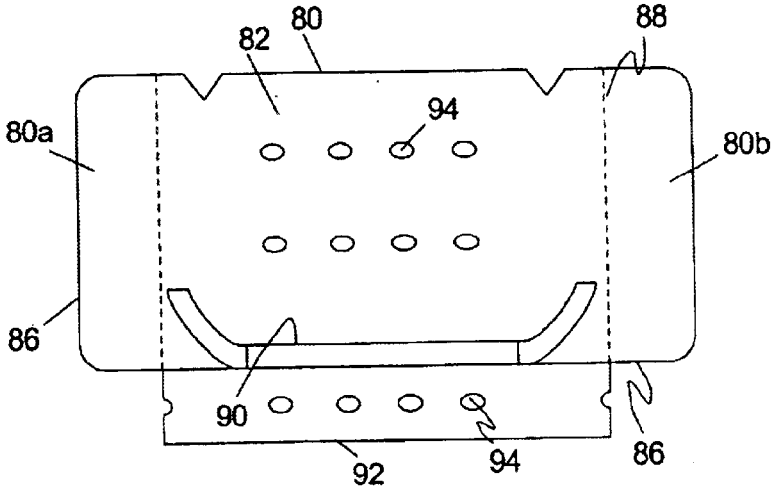
FIG. 4 is a front elevational view of one corner sealer.
Figure 9:
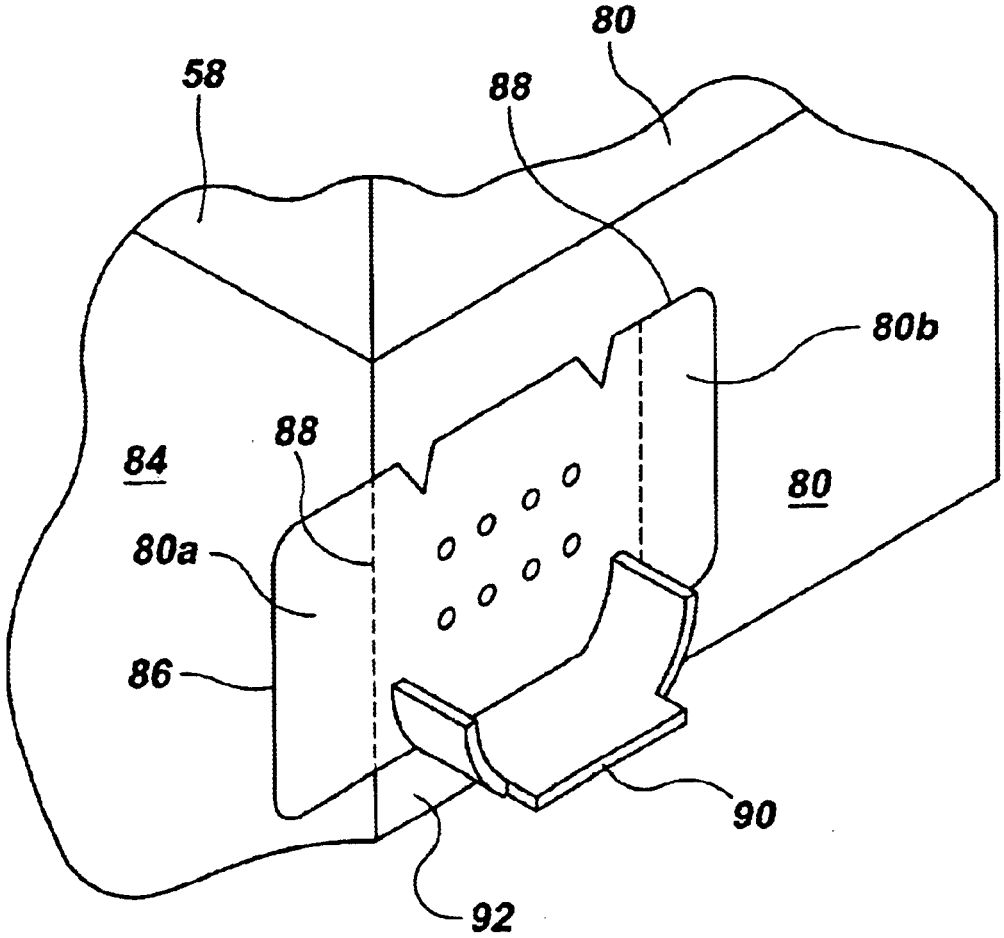
FIG. 9 is a perspective view showing the attachment of the corner sealer to the sill and adjacent one corner of a dwelling.

As shown in FIGS. 4 and 9, if the bottom-most end cap is not solid, though it may be, the structural member that is used to seal off the end caps 56 lowermost secured to vertical wall surfaces 58 and 60 is a corner sealer or bracket 80. The corner sealer 80 has a left side 80*a* and a right side 80*b* and includes a flat plate portion 82 that is disposed contiguous to wall surface 60, and, more specifically, to the sill 84 that extends about the dwelling and is located below wall surfaces, such as wall surfaces 58 and 60 of FIG. 9. Extending outwardly on the left side 80*a* and the right side 80*b* of the flat plate portion 82, and coplanar therewith, are opposed, removable alignment portions 86 that include indicia preferably in the form of hash marks 88 for demarcating each removable alignment portion 86 from the flat plate portion 82. The hash marks 88 also assist the individual in aligning the corner sealer 80 against the sill 84 so that the hash marks 88 can be aligned at the corner of the sill 84 in order to properly align and then secure the corner sealer 80 to the sill 84 of the dwelling. The corner sealer 80 also includes an outwardly facing trough or trough-shaped portion 90 that actually receives the main body portion 64 of the end cap 56, and a downwardly projecting tongue 92 that is coplanar with the flat plate portion 82. The flat plate portion 82 and the trough-shaped portion 92 both include a plurality of spaced-apart apertures 94 through which fasteners 28 can be inserted for mounting the corner sealer 80 to the sill 84.

Figure 15:
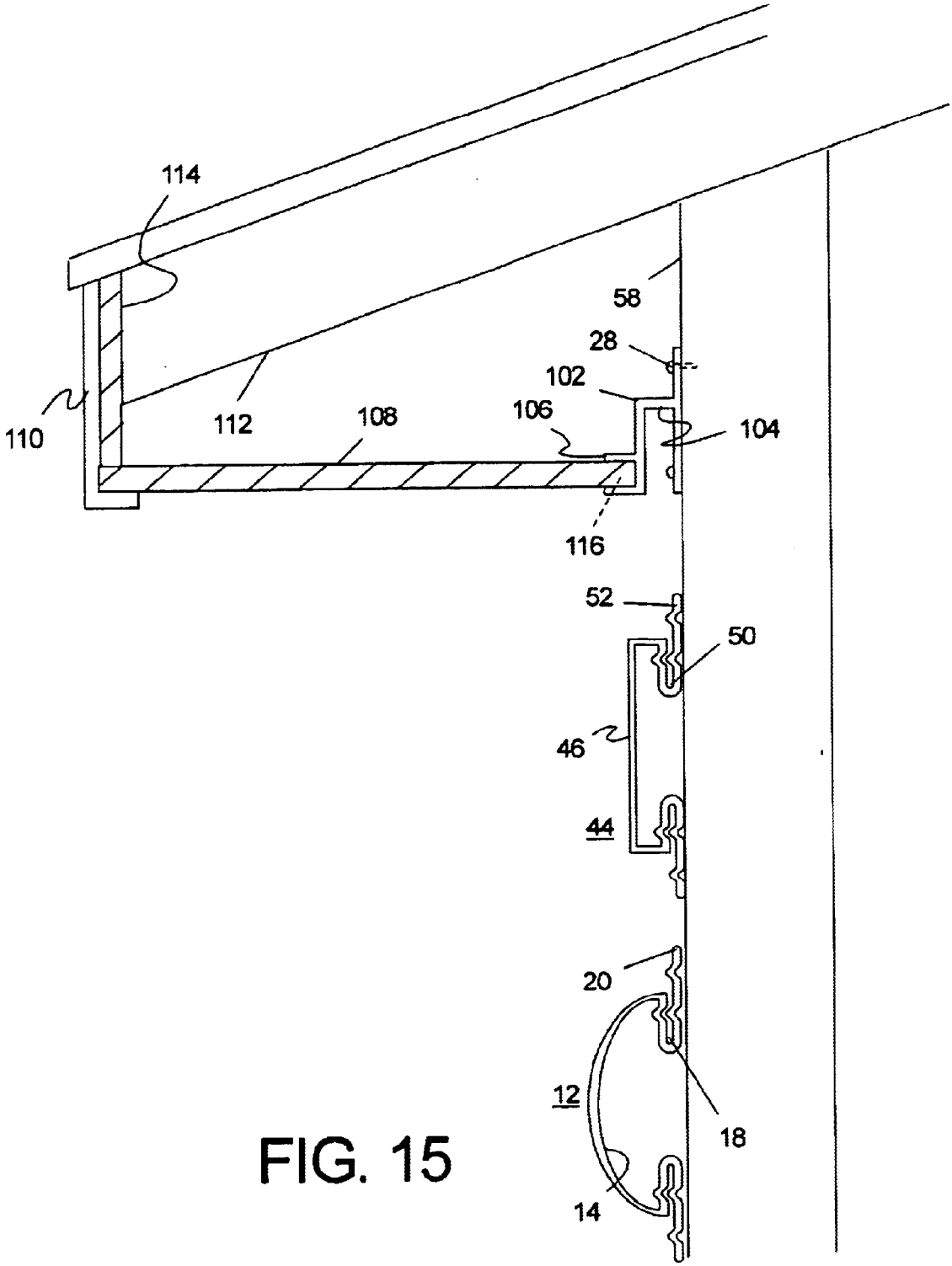
FIG. 15 is a side elevational view illustrating one method for finishing off the log wall siding system at the eave of the dwelling.

Illustrated in FIG. 15 is a soffit channel 102 for receiving the cambered side plank 12 or the starter plank member 44 mounted uppermost on the vertical wall surface. The soffit channel 102 is secured to the wall surface, such as wall surface 58, and includes an interior slot 104 for receiving and holding the upper tongue 20 of the respective uppermost mounted cambered side plank 12, and an outwardly facing soffit groove 106 for receiving and holding therein one peripheral edge of the soffit board or panel 108.

Also illustrated in FIG. 15 is a fascia member 110 which is securable to the eaves (rafter ends) 112 of the dwelling. The fascia member 110 is needed because it may often occur that the uppermost secured cambered side plank 12 will not be at the same level or height as the fascia board 114 that is secured lengthwise and horizontal at the eaves 112. The fascia member 110 includes an inwardly opening fascia slot 116 that would be disposed level with the soffit groove 106 of the soffit channel 102, and into which the opposite peripheral edge of the soffit board 108 would be inserted. The soffit board 108 would thus be secured in place in a horizontal orientation by the soffit channel 102 and the fascia member 110. The width of the fascia member 110 can be adjustable and in order to finish off the simulated log wall siding and fill the space between the uppermost secured cambered side plank 12 and the soffit channel 102. Also, one starter plank member 44 may need to be inserted in this space as shown in FIG. 13. This starter plank member 44 would be interconnected to the interior slot 104 of the soffit channel 102 and would be disposed level with the fascia member 110.

In using the above-described structural members to cover the vertical wall surfaces of a dwelling to simulate a log wall appearance, there is not a preferred method of construction. In general the cambered side planks 12, the starter plank members 44, and the starter strips 36 are attached to the various wall surfaces in the same manner as standard vinyl siding. Fasteners 28 are driven through the slots or apertures 26, 42 and 54 of the respective tongues 20, 40 and 52 of the upper longitudinal edges of each of the above-described elements. The tongue along the lower longitudinal edge of one structural element is inserted into the groove of the adjacent and below mounted structural element thus concealing the fastener 28 heads and locking the two structural members together. This interlocking arrangement will occur between starter strips 36 and starter plank members 44, between starter plank members 44 and the cambered, simulated half-log side planks 12, and between successive, vertically rising rows of the cambered side planks 12. Although the starter strips 36 are attached to the entire sill 84 of the house (front, back, and both sides), the starter strips 36 will only engage and interlock with the cambered side planks 12 on the front and back wall surfaces of the dwelling. The starter plank members 44 are mounted on the side wall surfaces of the dwelling in order to fill the half-space gap that will result should the individual commence installation of the wall siding system 10 by first mounting the cambered side planks 12 to the front and back wall surfaces of the dwelling.

In FIGS. 10–11 the above-described structural members are shown assembled together at various stages of completion for mounting to the vertical wall surfaces. Although it is not necessary to start at a particular corner of the dwelling, the individual would generally begin by securing the one or more cambered side planks 12 to the lowest part of the front wall surface immediately above the sill. This would follow the manner of constructing an actual log dwelling. After this step the individual could attach the cambered side planks 12 and end caps 56 in the same order that real log planks are built up for forming an actual log dwelling.

In the alternative the individual could attach all the cambered side planks 12—and appropriate end caps 56—to one side of the dwelling and then move to another side. This would reduce the onerous labor involved in assembling, disassembling, and moving scaffolding around the dwelling for securing, in turn, each row of cambered side planks 12. This method of completing one wall surface before moving to the next adjacent wall surface would be the most efficient method of securing the cambered side planks 12 to the walls of the dwelling. It is assumed that the starter strips 36 would have already been attached to the sill 84 of the dwelling along the front, back, and sides. In addition, one or more starter plank members 44 would have already been attached to the sides of the dwelling so that the lower tongue and groove edges 48 of these starter plank members 44 could be interconnected to the tongue 48 and groove 38 of the starter strips 36.

FIG. 14 specifically illustrates the securement of one starter strip 36, starter plank member 44, and one cambered side plank 12 to the side wall surface 60 of the dwelling. Installation of the simulated log siding elements to the front or back wall of the dwelling is the same except that the starter plank members 44 are not used. In order to achieve an alternating arrangement of end caps 56 at each corner of the dwelling extending from the lowermost part of the corner 62 up to the eave 112, installation would generally begin on the front and back wall with cambered side planks 12, not the starter plank members 44.

As illustrated in FIG. 14, the first step in applying the (vinyl) log siding elements would be to attach starter strips 36 in an end-to-end horizontal orientation to the entire sill 84 of the dwelling. Each starter strip 36 would be attached to the sill 84 by inserting fasteners 28 through the slots 42 spaced along the tongue 40 of each respective starter strip 36 and into the sill 84. The slightly oblong or oval slots 42 allow some lateral movement of each starter strip 36 in order to accommodate the expansion and contraction of the starter strips 36 resulting from changing weather and temperature conditions. The next simulated log siding element to be attached to sidewall surface 60 of the dwelling would be the starter plank member 44. The tongue 52 at the lower longitudinal edge 48 of this starter plank member 44 would be slidably inserted into the groove 38 of the starter strip 36. This interfitting arrangement both holds the lower half of the starter plank member 44 in place (since the lower longitudinal edge 48 is not fastened or nailed to the side wall surface 60) and also covers the fasteners 28 inserted through the slots 42 of the starter strip 36. This starter plank member 44 would in turn be secured to the side wall surface 60 by inserting fasteners 28 through the slots 54 spaced along the tongue 52 of the upper longitudinal edge 48 and into the side wall surface 60. Then the tongue 20 of the lower longitudinal edge 16 of the first cambered side plank 12 would be inserted into the groove 50 of the upper longitudinal edge 48 of this starter plank member 44. This action both interlocks the first cambered side plank 12 to the starter plank member 44 and also conceals the fasteners 28 inserted through the slots 54 along the tongue 52 of the upper longitudinal edge 48 of the starter plank member 44.

Each starter plank member 44 and each cambered side plank 12 comprise, in essence, a double tongue and groove arrangement in so far as both longitudinal edges 16 and 48 of both structural elements include one tongue 20 and 52 and one groove 18 and 50. The grooves 18 and 50 of the starter plank members 44 and the cambered side planks 12 are shaped to slidably receive the corresponding tongues 20 and 52 of the starter plank members 44 and the cambered side planks 12. Thus each starter plank member 44 and cambered side plank 12 is reversible and does not have a unique top and bottom. Maximum flexibility in application is thus obtained and it is not necessary to manufacture specially configured starter plank members and cambered side planks for attachment to the left side or corner or the right side or corner of the particular dwelling.

After the starter strip or strips 36 have been attached to the sill 84, and before the end caps 56 are secured adjacent the corners of the dwelling, one corner sealer 80 must be secured at each corner of two opposed sides of the dwelling, such as the corner 62 formed by adjoining rear wall 58 and side wall 60. Each corner sealer 80 includes a pair of spaced-apart notches that facilitate the alignment of the corner sealer 80 to the respective wall surface while the downwardly projecting tongue 92 of the corner sealer 80 can be slidably received into the groove 38 of the starter strip 36. This interconnects the corner sealer 80 to the starter strip 36 and also covers the fasteners 28 that are used to attach each starter strip 36 to the sill 84 of the dwelling. The next step is to commence attachment of the ends caps 56 to the corner 62 of the dwelling starting with the end cap 56 that would be disposed on the trough-shaped portion 90 of the corner sealer 80. The regular tab 70 of this end cap 56 is secured to one spacer 78 and the t-shaped tab 74 would be secured to adjoining wall surface 58 or 60 next to the other spacer 78. The next end cap 56 would be secured to the wall surfaces 58 or 60 so it will project past the corner 62, and at a right angle to the below first mounted end cap 56. Thus, the regular tab 70 and the t-shaped tab 74 of what would be the second mounted end cap 56 would be secured to wall surfaces 58 and 60 in a manner opposite to the securement of the t-shaped tab 74 and the regular tab 70 of the first or lowest mounted end cap 56. This alternating securement of end caps 56 along and straddling one corner 62 of the dwelling would continue up the adjoining wall surfaces 58 and 60 to eave 112. This would be repeated at the other three corners of the dwelling. Thus, an alternating or staggered arrangement of end caps 56 would thus be formed wherein all the end caps 56 extending past one wall surface will be disposed at a right angle to all the end caps 56 extending past the adjoining wall surface thereby creating an interlocking, notched arrangement of simulated wood planks at each corner of the dwelling.

FIG. 15 illustrates one method of completing the installation of the log wall siding system 10 adjacent the eave 112 of the dwelling for sidewall surface 60. One soffit channel 102 is secured beneath the eave 112 and is level with the fascia member 110 that is secured to the fascia board 114. The peripheral opposed edges of a soffit panel or board 108 are inserted in and held by the soffit groove 106 and the fascia slot 116. Because the cambered side plank 12 uppermost mounted to this side wall surface 60 may not be at the same height as the cambered side plank 12 mounted to the front and back wall surface, one starter plank member 44 is used to fill the space between the soffit channel 102 and side plank 12 and finish off the log wall siding on this side wall surface 60. The upper tongue 52 of the starter plank member 44 is inserted into the downwardly opening interior slot 104 of the soffit channel 102 and held therein to avoid face nailing this starter plank member 44 to the side wall 60. The lower tongue 52 of this starter plank member 44 would then be slidably received within the upper longitudinal groove 18 of the cambered side plank 12, thus covering the fasteners 28 and securing this cambered side plank 12 to the side wall surface 60 and interlocking both structural elements together. The fascia member 110 could also be adjusted, as shown in FIG. 15, to assure that the starter plank member 44 is located at the same height as the fascia board 114 at the eave 112.

The foregoing is considered as illustrative only of the principles of the invention. Since numerous modifications and changes will readily occur to those skilled in the art, it is not desired to limit the invention to the construction shown and described. Accordingly, all suitable modifications and equivalents may be resorted to falling within the scope of the invention.

I claim:

1. A wall siding system for simulating a notched log wall corner construction, the wall siding system, comprising:

a plurality of end caps for securement to at least two adjacent vertical wall surfaces that meet at a corner, each said end cap including a main body portion, a cambered exterior end, a wall-facing end, a t-shaped tab attached to said wall-facing end projecting laterally from said main body portion configured to attach to one of said vertical wall surfaces at said corner, and a regular tab projecting from the wall-facing end opposite from and perpendicular to the t-shaped tab.

2. The wall siding system of claim 1, wherein a spacer element is provided to facilitate securement of the end caps to said vertical wall surfaces.

3. The wall siding system of claim 1, wherein said plurality of end caps are pre-formed as a group of end caps.

4. The wall siding system of claim 1, wherein said plurality of end caps are hollow.

5. The wall siding system of claim 1 further comprising a plurality of elongate side planks with each said side plank having a cambered central portion, a pair of oppositely disposed longitudinal edges with one of said longitudinal edges being configured to form a tongue and the other of said longitudinal edges being configured to form a groove so that the side planks can be interconnected at their respective long edges for arrangement on said vertical wall surfaces.

6. The wall siding system of claim 5 wherein each said side plank includes at least one projection member with each said projection member extending laterally from a respective end of the cambered central portion and positioned on the cambered central portion midway between each longitudinal edge.

7. The wall siding system of claim 6 wherein each side plank is configured to simulate in appearance a log plank.

8. A wall siding system for simulating a notched log wall corner construction, the wall siding system, comprising:

at least two spacer elements, each said spacer element attached to one of adjacent vertical wall surfaces near a corner;

a plurality of end caps, each said end cap including a cylindrical-shaped main body portion, a cambered exterior end, a wall-facing end, a t-shaped tab attached to said wall-facing end and offset therefrom by an extension member perpendicularly attached to the wall-facing end configured to be secured on said wall next to one of said spacer elements, whereby said spacer is situated underlying said wall-facing end, and a regular tab projecting from the wall-facing end opposite from and perpendicular to the t-shaped tab configured to attach to the other of said spacer elements on the other of said vertical wall surfaces.

9. The wall siding system of claim 8, wherein said spacer element is a generally rectangular nailing strip.

10. The wall siding system of claim 8, wherein said spacer element is part of a corner flashing.

11. The wall siding system of claim 8, further comprising a plurality of elongate side planks with each said side plank having a cambered central portion, a pair of oppositely disposed longitudinal edges with one of said longitudinal edges being configured to form a tongue and the other of said longitudinal edges being configured to form a groove so that the side planks can be interconnected at their respective long edges for arrangement on said vertical wall surfaces.

12. The wall siding system of claim 11 wherein each side plank is configured to simulate in appearance a log plank.

13. The wall siding system of claim 11 wherein each side plank includes an elongated, flat central portion defined between oppositely disposed longitudinal edges.

14. The log wall siding system of claim 8, further comprising a corner sealer having a plate portion for attachment to the wall surface and an outwardly facing trough portion for receiving the end cap lowermost secured to the wall surface, the corner sealer further comprising alignment portions extending outwardly on a left side and a right side of the plate portion.

* * * * *